US009934666B2

(12) United States Patent
Haines

(10) Patent No.: US 9,934,666 B2
(45) **Date of Patent: *Apr. 3, 2018**

(54) SECURITY APPARATUS AND SYSTEM

(71) Applicant: Nicole R. Haines, Charlotte, NC (US)

(72) Inventor: Nicole R. Haines, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/051,118

(22) Filed: Feb. 23, 2016

(65) Prior Publication Data

US 2016/0171856 A1 Jun. 16, 2016

Related U.S. Application Data

(63) Continuation of application No. 13/737,098, filed on Jan. 9, 2013, now Pat. No. 9,299,234.

(51) Int. Cl.
*G08B 1/08* (2006.01)
*G08B 13/24* (2006.01)

(52) U.S. Cl.
CPC ..... *G08B 13/2494* (2013.01); *G08B 13/2491* (2013.01)

(58) Field of Classification Search
None
See application file for complete search history.

(56) References Cited

U.S. PATENT DOCUMENTS 4,796,015 A * 1/1989 Admire, Jr. ..... G08B 17/113 340/628
5,155,474 A * 10/1992 Park ..... G08B 13/19619 340/541
5,457,442 A * 10/1995 Lucero ..... F21V 23/0442 340/539.1
5,463,595 A * 10/1995 Rodhall ..... A01M 29/18 340/426.23
5,590,953 A * 1/1997 Haslam ..... F21S 8/033 362/147
5,673,016 A * 9/1997 Lutes ..... H04M 11/025 340/326
5,748,088 A 5/1998 Afilani
5,907,280 A 5/1999 Afilani
6,348,686 B1 * 2/2002 Howard ..... G01J 5/02 250/216
6,411,099 B1 6/2002 Afilani
6,496,114 B1 12/2002 Afilani
6,696,971 B2 * 2/2004 Tukin ..... G08B 7/06 340/555
6,727,938 B1 * 4/2004 Randall ..... G08B 13/19602 348/143

(Continued)

*Primary Examiner* — Julie Lieu
(74) *Attorney, Agent, or Firm* — Ashley Law Firm P.C.; Stephen S. Ashley, Jr.

(57) ABSTRACT

A security system according to an embodiment of the invention includes motion sensor units for positioning at desired locations of a building structure. Each motion sensor unit includes a motion sensor adapted for detecting motion external to the building structure. The system can include a mobile alarm display unit operatively connected to the motion sensor units. The mobile alarm display unit can include a plurality of alarm indicators corresponding to the motion sensor units. Each alarm indicator can be operatively linked to a particular one of the motion sensor units, and detection of motion by the particular motion sensor unit activates the corresponding alarm indicator linked to the particular motion sensor unit.

18 Claims, 8 Drawing Sheets

(56) References Cited

U.S. PATENT DOCUMENTS 6,762,686 B1 * 7/2004 Tabe ..... G08B 25/08 340/541
7,339,471 B1 * 3/2008 Chan ..... G08B 15/002 315/159
7,724,133 B2 * 5/2010 Laitta ..... G08B 13/19652 340/541
8,531,291 B2 * 9/2013 Tran ..... G06F 19/3418 340/3.1
8,710,984 B2 4/2014 Wilson et al.
2002/0014971 A1 * 2/2002 Ferraro ..... G08B 13/1409 340/689
2003/0227391 A1 * 12/2003 Beasley ..... G08B 13/19 340/693.6
2005/0184867 A1 * 8/2005 Osann, Jr. ..... G06Q 50/06 340/539.25
2006/0146537 A1 * 7/2006 Murray ..... H05B 37/0227 362/276
2006/0226973 A1 * 10/2006 Catlin ..... G08B 17/10 340/539.11
2007/0013513 A1 * 1/2007 Tang ..... G08B 13/19634 340/541
2008/0001734 A1 * 1/2008 Stilp ..... G05B 9/03 340/539.22
2008/0297346 A1 * 12/2008 Brackmann ..... B60P 3/03 340/572.1
2009/0135006 A1 * 5/2009 Schoettle ..... G08B 13/00 340/540
2010/0298957 A1 * 11/2010 Sanchez Rocha ..... G05B 15/02 700/90
2013/0158721 A1 * 6/2013 Somasundaram . G05D 23/1917 700/276
2014/0014837 A1 * 1/2014 Schnell ..... G03B 17/00 250/338.1
2014/0090310 A1 * 4/2014 Greene ..... E04D 3/351 52/1
2014/0094137 A1 * 4/2014 Gregory ..... H04W 4/02 455/404.2

* cited by examiner

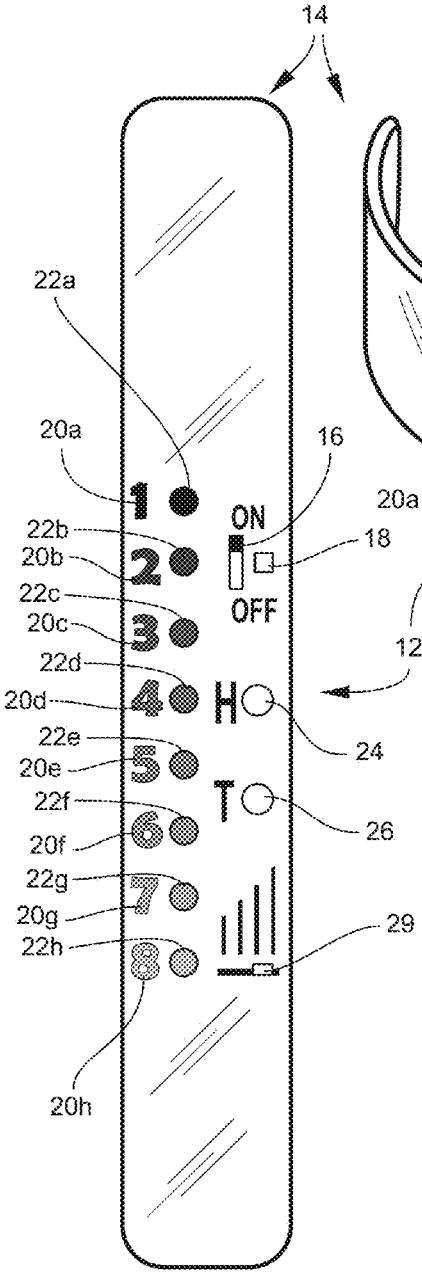
Fig. 4
Fig. 5
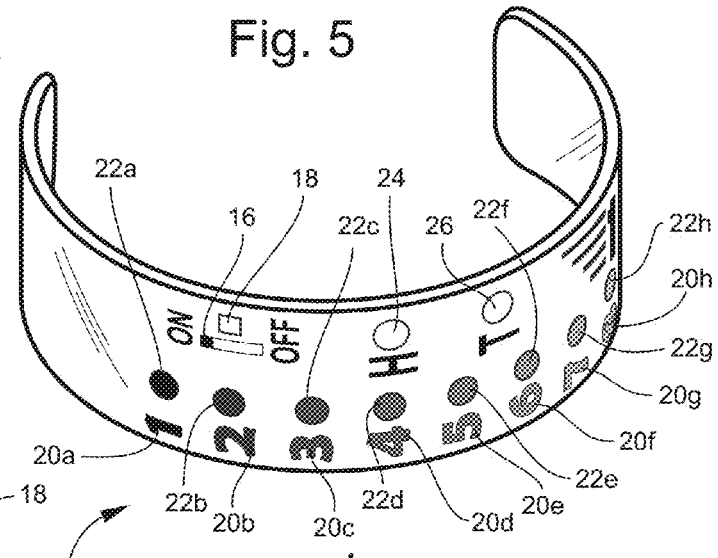
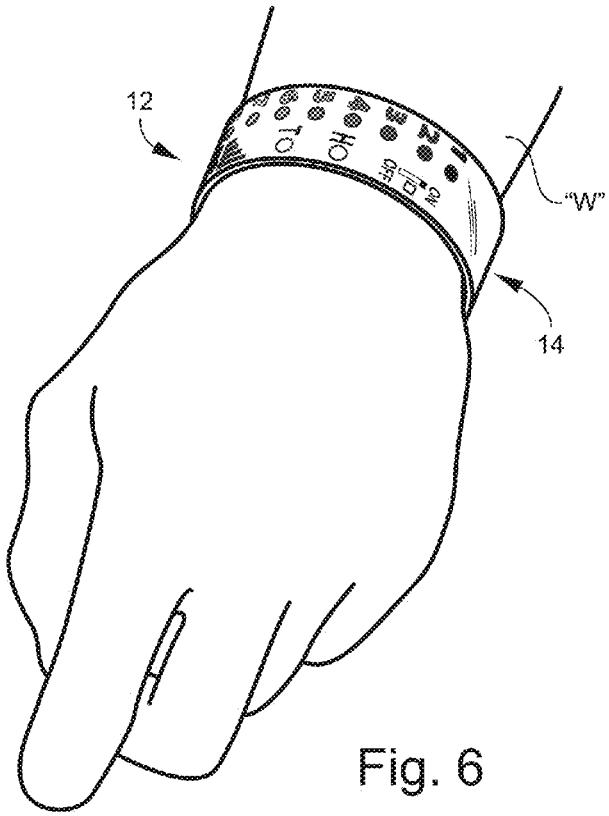
Fig. 6

SECURITY APPARATUS AND SYSTEM

CROSS REFERENCE TO RELATED APPLICATIONS

This application is a continuation of application Ser. No. 13/737,098, filed Jan. 9, 2013, which is incorporated herein by reference.

TECHNICAL FIELD AND BACKGROUND OF INVENTION

The present invention relates to a security system. One embodiment of the invention comprises a security system having a mobile apparatus that can alert the user of a potential security breach at a particular location of the user's residence.

There exist various systems for improving or maintaining the security of a residence, office or other building. A common problem with such existing systems is unintended alarm activations caused by movement of persons or pets within a residence who are not intruders, but rather occupants of the residence. Once activated, often the user cannot deactivate the alarm and prevent police or other emergency responders from being unnecessarily called to the residence. Such unintended activations can be costly and inconvenient.

Also, many existing security systems require the user to subscribe to and pay a monthly fee to maintain the system. However, many people interested in improving their home's security are unable or uninterested in committing to an ongoing monthly subscription expense.

SUMMARY OF INVENTION

Therefore, one object of the present invention is to provide a security system in which the user is alerted when there is a potential breach of security, while giving the user control over whether to alert authorities in response to the alert. Another object of the invention is to provide a mobile security apparatus that can be worn by the user and can alert the user of the location of a potential breach of security. Yet another object of the invention is to provide a security system that does not require a monthly subscription fee. These and other objects of the present invention can be achieved in various embodiments of the invention described herein.

One embodiment of the invention comprises a security system comprised of a plurality of motion sensor units for positioning at desired locations of a building structure, in which each motion sensor unit houses a motion sensor adapted for detecting motion external to the building structure. The system includes a mobile alarm display unit operatively connected to the plurality of motion sensor units that comprises a plurality of alarm indicators corresponding to the plurality of motion sensor units. Each alarm indicator is operatively linked to a particular one of the plurality of the motion sensor units, and detection of motion by the particular motion sensor unit activates the corresponding alarm indicator linked to the particular motion sensor unit.

According to another embodiment of the invention, a security system comprises at least one motion sensor unit for attaching to a building structure. The motion sensor unit houses a sensor section comprising a motion sensor adapted for detecting motion, and a shield section adjacent to the inner surface of the sensor section. The shield section comprises shielding material that provides a barrier to the sensor section and blocks the sensor from detecting motion proximate the inner surface of the sensor section. As such, the sensor does not detect motion occurring internally of the building structure when the sensor unit is positioned with the shield section facing the interior of the building structure. Alarm means can be operatively connected to the motion sensor unit so that detection of motion by the sensor activates the alarm means.

According to another embodiment of the invention, the alarm means can be an alarm section positioned on the motion sensor unit. The alarm means can produce light or sound upon the motion sensor detecting motion.

According to another embodiment of the invention, the shield section is positioned intermediate the sensor section and the alarm section.

According to another embodiment of the invention, the alarm means can include an alarm display unit operatively connected to the motion sensor unit. The alarm display unit includes at least one alarm indicator corresponding to the motion sensor unit, and the alarm indicator can produce light, sound and/or vibration upon detection of motion by the motion sensor.

According to another embodiment of the invention, the alarm display unit can include a bracelet adapted to be worn on a user's wrist.

According to another embodiment of the invention, the alarm means can be an alarm display unit operatively connected to the motion sensor unit. The alarm display unit includes at least one alarm indicator corresponding to the motion sensor unit, and the alarm indicator produces light, sound and/or vibration upon detection of motion by the at least one motion sensor.

According to another embodiment of the invention, the shielding material comprises sheet metal.

According to another embodiment of the invention, the motion sensor can be a tomographic motion detection sensor that can detect motion through obstructions other than the shield section.

According to another embodiment of the invention, the security system can include a motion sensor unit bracket for housing the motion sensor unit. The bracket comprises a first section having an inner side and an outer side, and a first section opening shaped and sized to receive the at least one motion sensor unit. A second section is pivotally connected to the first section, and has a countersunk opening having a shape and size complementary to the first section opening, such that the bracket is moveable from an open position in which the inner side of the first section is exposed and the first section opening can receive the sensor unit, to a closed position in which the second section is pivoted to cover the inner surface of the first section so that the sensor unit is contained within the bracket.

According to another embodiment of the invention, the bracket can include attachment means, such as an adhesive, for attaching the bracket to the building structure.

According to another embodiment of the invention, a security system at least one motion sensor unit for attaching to a building structure. The motion sensor unit includes a sensor section comprising a tomographic motion sensor adapted for detecting motion through opaque material, and a shield section adjacent to an inner surface of the sensor section. The shield section comprises shielding material providing a barrier to the sensor section and blocking the sensor from detecting motion proximate the inner surface of the sensor section, so that the sensor does not detect motion occurring internally of the building structure when the sensor unit is positioned with the shield section facing the interior of the building structure. Alarm means can be operatively connected to the tomographic motion sensor, such that detection of motion by the tomographic motion sensor activates the alarm means.

According to another embodiment of the invention, the alarm means can be an alarm section positioned on the motion sensor unit that produces light and/or sound upon the motion sensor detecting motion.

According to another embodiment of the invention, the shield section is positioned intermediate the sensor section and the alarm section.

According to another embodiment of the invention, the system includes a plurality of motion sensor units for positioning at desired locations of a building structure.

According to another embodiment of the invention, the alarm means can be an alarm display unit operatively connected to the plurality of motion sensor units. The alarm display unit includes a plurality of alarm indicators corresponding to the plurality of motion sensor units, and each alarm indicator is operatively linked to a particular one of the plurality of the motion sensor units. Detection of motion by a particular motion sensor unit activates the corresponding alarm indicator linked to that particular motion sensor unit.

According to another embodiment of the invention, each of the plurality of motion sensor units includes an alarm section having a sensor alarm indicator that activates upon the motion sensor detecting motion. The shield section can be positioned intermediate the sensor section and the alarm section.

According to another embodiment of the invention, each sensor alarm indicator has a distinguishing alphanumeric character, and the plurality of alarm indicators of the alarm display unit includes a plurality of alphanumeric characters. Each of the alarm indicator alphanumeric characters correspond to one of the alphanumeric characters of the sensor alarm indicators.

According to another embodiment of the invention, each of the alarm indicator alphanumeric characters and each of the alphanumeric characters on the motion sensor units is illuminable with a distinctively colored light.

Another embodiment of the invention comprises a bracket for housing a motion sensor unit adapted for detecting motion. The bracket comprises a first section having an inner side and an outer side, and a first section opening shaped and sized to receive the motion sensor unit. A second section is pivotally connected to the first section, and has a countersunk opening having a shape and size complementary to the first section opening, such that the bracket is moveable from an open position in which the inner side of the first section is exposed and the first section opening can receive the motion sensor unit, to a closed position in which the second section is pivoted to cover the inner surface of the first section, such that the motion sensor unit is contained within the bracket. The bracket can include attachment means for attaching the bracket to a building structure.

BRIEF DESCRIPTION OF THE DRAWINGS

FIG. 4 is a top plan view of a security apparatus according to a preferred embodiment of the invention;

FIG. 5 is a perspective view of the security apparatus of FIG. 4;

FIG. 6 is an environmental perspective view of the apparatus of FIG. 4;

DETAILED DESCRIPTION OF PREFERRED EMBODIMENTS OF INVENTION

Figure 9:
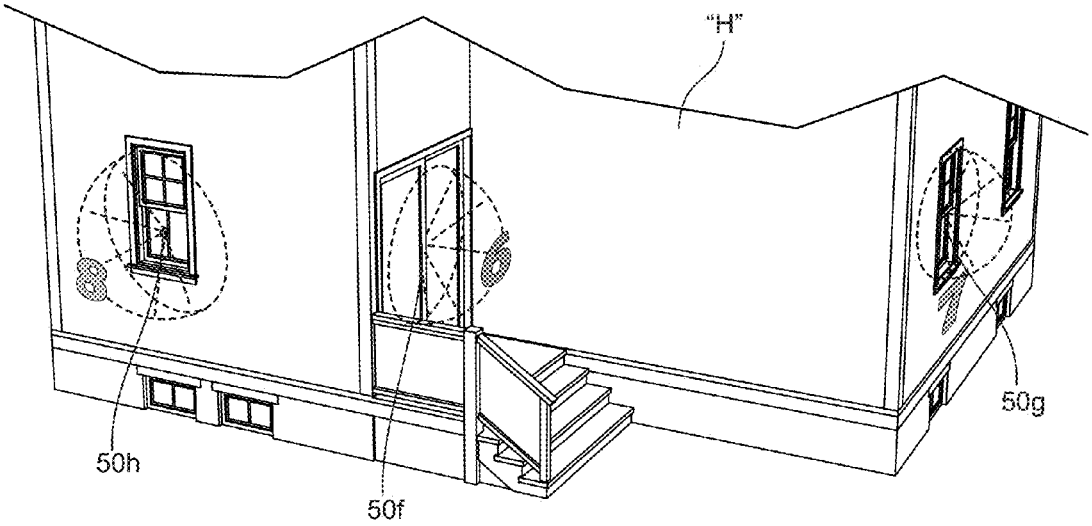
Figure 10:
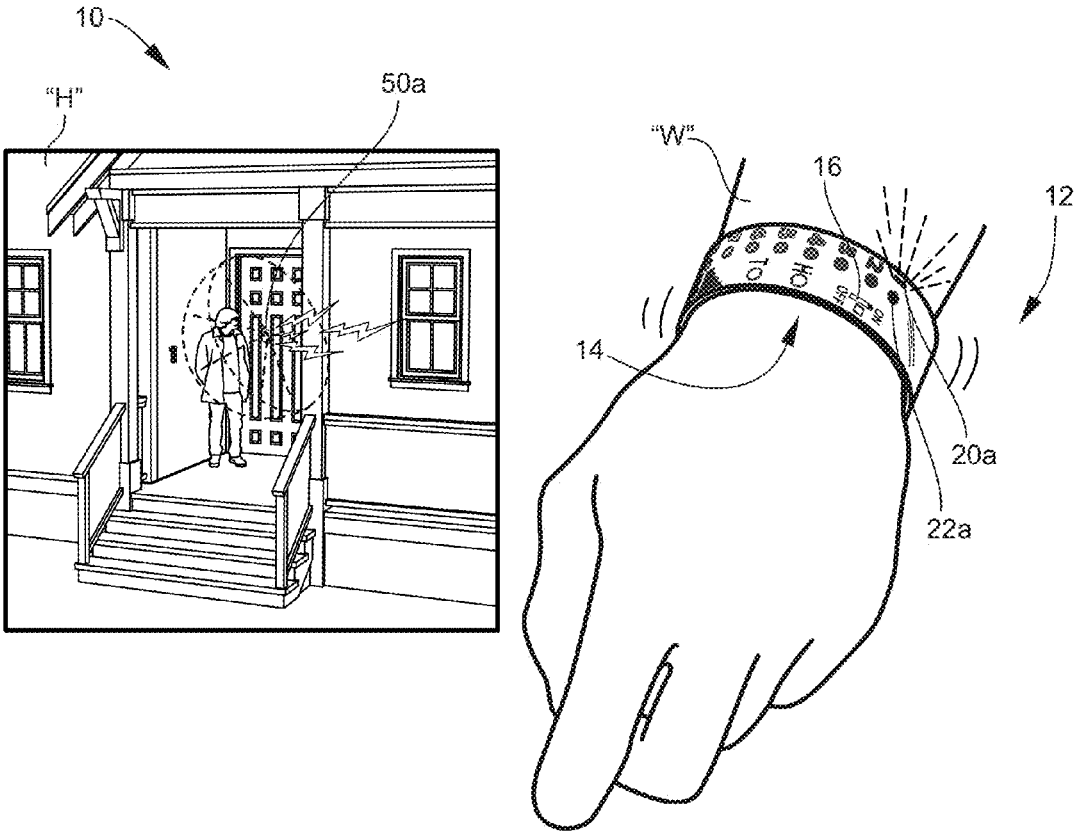
FIG. 10 is a partial environmental view of a security system according to a preferred embodiment of the invention.

A security system according to a preferred embodiment of the invention is illustrated in FIGS. 1-16, and shown generally at reference numeral 10 in FIG. 10. The security system 10 comprises a mobile alarm display unit 12 operatively connected to a plurality of motion sensor units 50.

Figure 7:
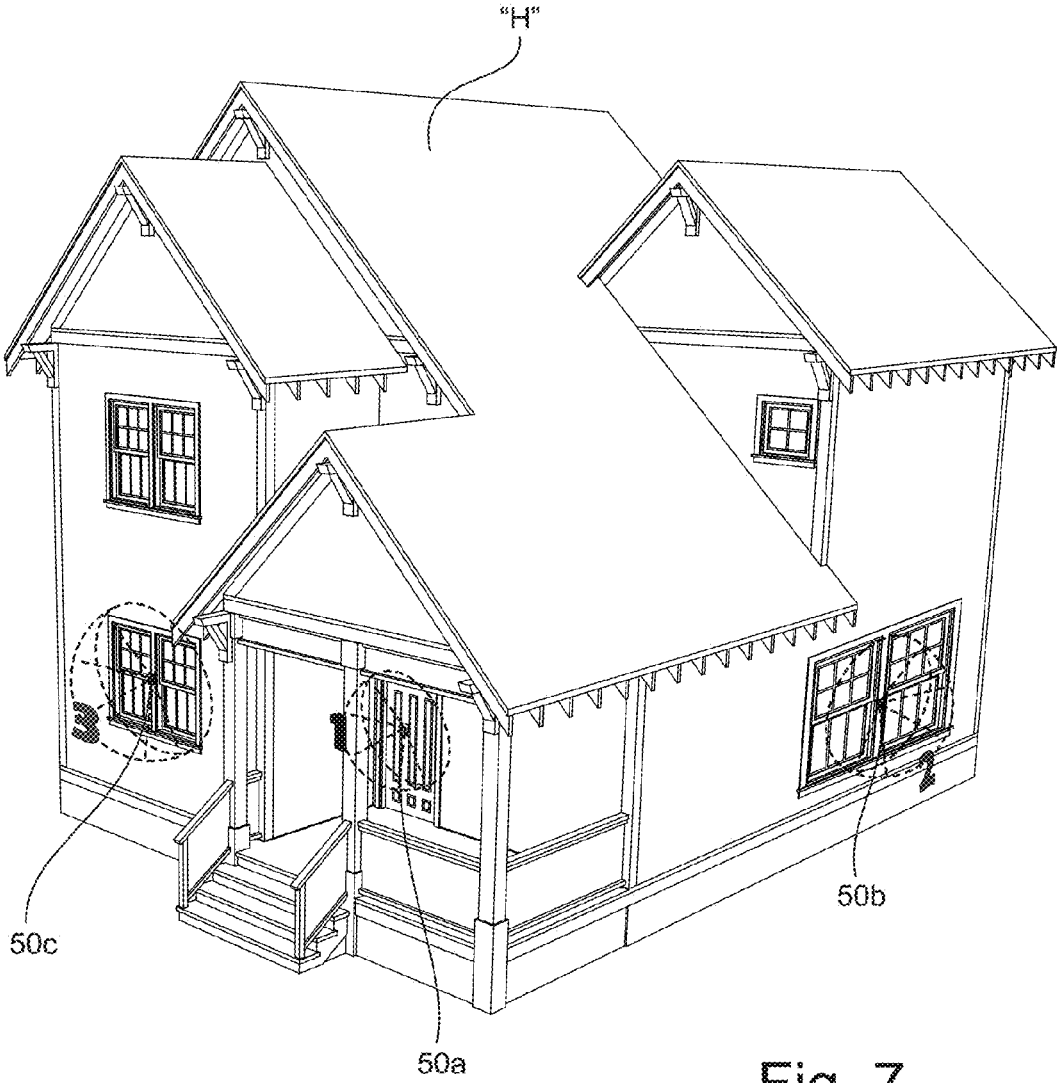
FIGS. 7-9 are partial environmental perspective views of a security system according to a preferred embodiment of the invention.
Figure 8:
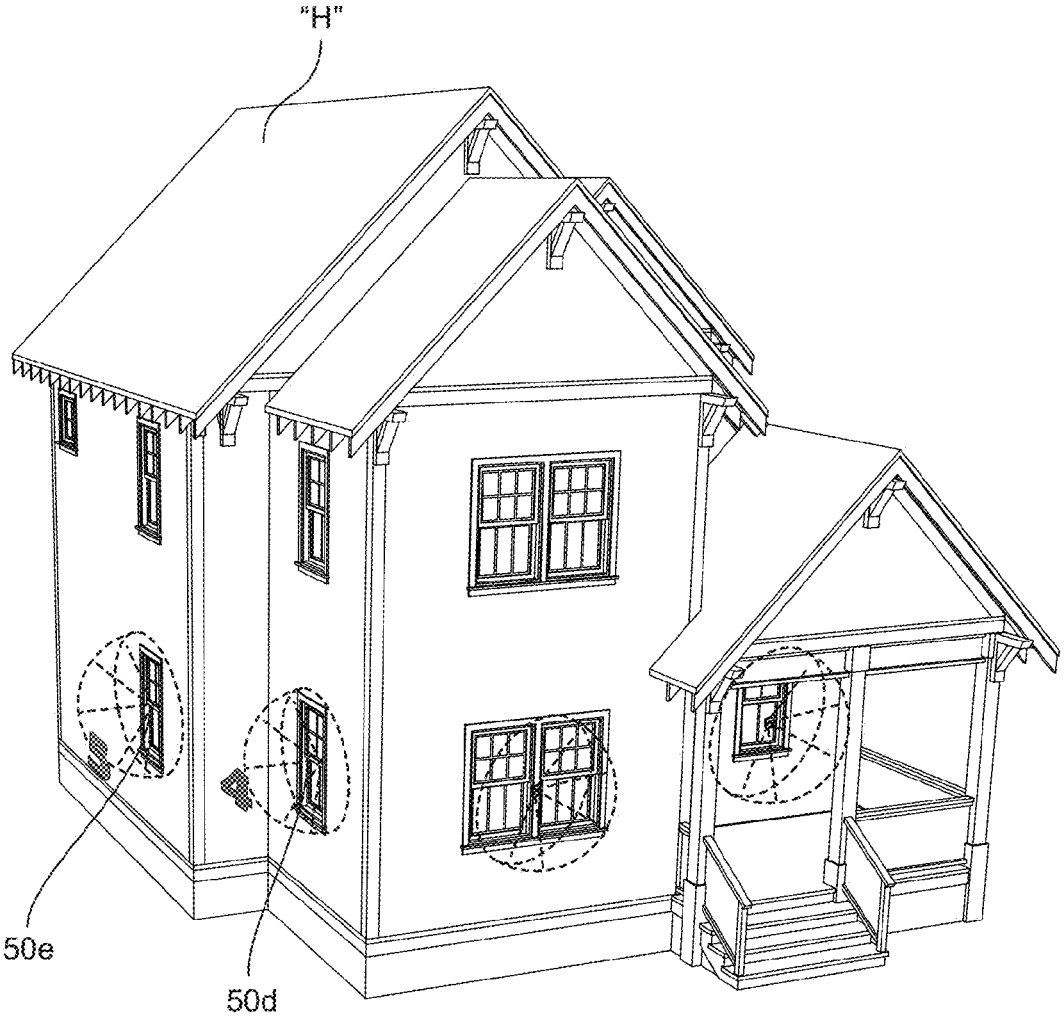

This particular embodiment 10 of the invention includes a total of eight motion sensor units 50, shown individually at reference numerals 50*a-h* in FIGS. 7-9, however there can be any number of motion sensor units 50. Each motion sensor unit 50*a-h* has identical structure, and is therefore described hereafter and illustrated generally at reference numeral 50 in FIGS. 1-3.

Figure 2:
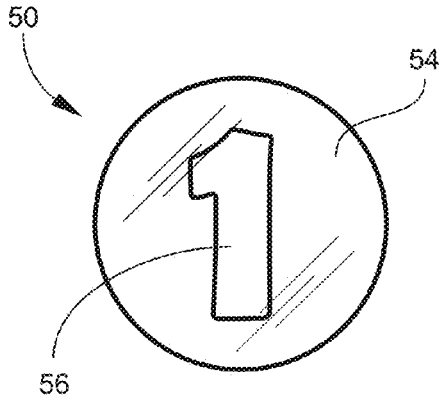
FIG. 2 is a top plan view of the motion sensor unit of FIG. 1.
Figure 3:
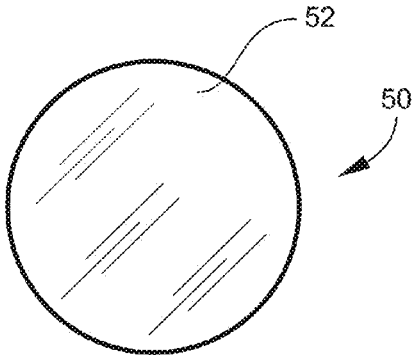
FIG. 3 is a bottom plan view of the motion sensor unit of FIG. 1.
Figure 1:
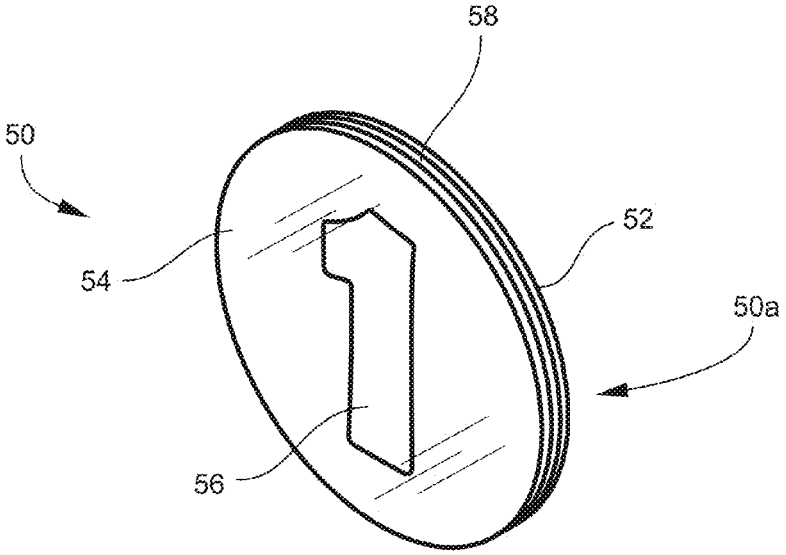
FIG. 1 is a perspective view of a motion sensor unit according to a preferred embodiment of the invention.

The motion sensor units 50 can be positioned at desired locations within a building structure, such as a residence or office. Each motion sensor unit 50 can be in the shape of a round tablet, as shown in FIGS. 1-3, or can be other suitable shapes. The motion sensor units 50 are preferably black or white.

Each motion sensor unit 50 includes a motion detection sensor compartment 52, as shown in FIGS. 1 and 3. The sensor compartment 52 can include tomographic motion detection sensors, such as described in U.S. Pat. No. 8,710,984 for SYSTEMS AND METHODS OF DEVICE-FREE MOTION DETECTION AND PRESENCE DETECTION, issued Apr. 29, 2014 and assigned to Xandem Technology, LLC, and which is incorporated herein by reference. As such, sensors in the sensor compartment 52 can sense motion through most physical obstructions.

The sensor unit 50 also includes a front compartment 54, shown in FIGS. 1 and 2, that contains an alarm that sounds when the sensors in the sensor compartment 52 detects motion. The alarm can be a loud piercing sound that emanates when motion is detected. The alarm alerts and directs occupants of the residence to the area of intrusion. The alarm can also be heard from the outside to distract, confuse and ultimately scare away an intruder. The front compartment 54 of each sensor unit 50 can have a distinguishing marking, such as an alphanumeric character 56 comprised of a carved out hollowed number overlayed by a transparent heat resistant material. Underneath the hollowed number-shaped area 56 lies a small neon light bulb which lights up the number 56, which can be seen from the outside of the sensor unit 50. The lighted number 56 on the front compartment 54 attracts attention and serves as a guide for occupants in the dark to confirm where motion has been detected.

The sensor unit 50 includes a middle shield compartment 58, shown in FIG. 1, containing material having electromagnetic shielding properties, such as sheet metal. The middle shield compartment 58 blocks the sensors in the sensor compartment 52 from detecting motion on the opposite side of the shield compartment 58. As such, the middle shield compartment 58 prevents the sensors 52 from detecting movement within the interior of a building structure when the motion sensor unit 50 has been positioned with the sensor compartment 52 facing outward. This allows people and pets inside the building structure to move freely around the interior of the building structure without triggering an alarm. Preferably, the middle shield compartment 58 is comprised of a thin sheet of metal made of copper or nickel.

As shown in FIGS. 4-6, the mobile alarm display unit 12 can comprise a bracelet 14 to be worn on the wrist "W" of the user. The alarm display unit 12 is operatively connected to the plurality of motion sensor units 50, and comprises a plurality of alarm indicators 20*a-h* corresponding to the plurality of motion sensor units 50*a-h*, respectively. As shown in FIG. 4, the alarm indicators 20*a-h* can be comprised of eight illuminable alphanumeric characters, such as numbers one through eight, corresponding to the same alphanumeric characters on the motion sensor units 50*a-h*, respectively. Preferably, the indicator numbers 20*a-h* on the display unit 12 and the numbers of the motion sensor units 50*a-h* are illuminable by neon lights of varying color, and each indicator number 20*a-h* has the same color light as its corresponding motion sensor unit 50*a-h*, respectively. So for example, the first indicator number 20*a* and the number on the alarm compartment of the first motion sensor unit 50*a* can be illuminated with a blue light.

As shown in FIGS. 7-9, the motion sensor units 50*a-h* can be positioned at various locations, such as on windows and doors, within a building structure, such as a house "H". On windows, the motion sensor units 50 are preferably mounted midway on the window's trim, and not on the glass of the window as this would make the sensor unit 50 visible to intruders. On doors, the sensor units 50 are preferably positioned on either bottom corner of the interior surface of the door with the numbers on the first compartment 54 of the motion sensors 50 facing inwardly toward the interior of the house "H." The motion sensor unit 50 should not be mounted on a storm door, as the numbers on the sensor unit 50 would not be visible to occupants inside house "H". As such, the sensor units 50 are undetected by intruders outside the house "H" and cannot be removed by anyone from the outside.

Each motion sensor unit 50*a-h* can detect motion from any angle of any object resembling the size of a human outside of the home only, within a range of approximately five feet of the location of each motion sensor unit 50*a-h*. As such, occupants of the home "H" can walk around inside the home freely, while the motion sensor 52 are activated, without triggering sensors 52 and setting off an alarm. Preferably, the motion sensor units 50*a-h* are numbered one through eight to correspond to the indicator numbers 20*a-h* on the mobile display unit 12. For example, motion sensor unit 50*a* can have a number "1" denoted by reference numeral 56 located on the front compartment 54, as shown in FIGS. 1 and 2. Preferably, the numbers 56 contain neon lights having varying colors corresponding to colors of the indicator numbers 20*a-h* on the bracelet 14, and a corresponding deactivation button 22*a-h* located next to each of the indicator numbers 20*a-h* on the bracelet 14, as shown in FIG. 1. Preferably, the motion sensor units 50*a-h* are black or white.

Each alarm indicator 20*a-h* is operatively linked to one of the motion sensor units 50*a-h*, respectively, such that detection of motion by one of the motion sensor units 50*a-h* activates the corresponding alarm indicator 20*a-h*. For example, motion sensor number one 50*a* is electronically linked to alarm indicator number one 20*a* on the display unit 12. When motion sensor number one 50*a* detects motion the alarm compartment 54 of the sensor 50*a* is activated, and the alarm indicator number one 20*a* on the display unit 12 is activated, as shown in FIG. 10.

Activation of the alarm compartment 54 of the motion sensor 50*a* is comprised of the sounding of a sound alarm emanating from the alarm compartment 54 and the colored illumination of the number 56 on the alarm compartment 54. Illumination of the number 56 can be continuous or can blink intermittently. In addition, detection of motion by motion sensor 50*a* activates the linked alarm indicator 20*a*, causing the corresponding colored indicator number one 20*a* on the bracelet 14 to light up and simultaneously causing the bracelet 14 to vibrate, producing a strongly felt vibration sensation to the wearer, as shown in FIG. 10. As such, the wearer can have an opportunity to investigate the area of intrusion before the intruder physically enters into the home by breaking and opening a door or window. Due to the mobility of the bracelet 14, there is no need for the user to run to a stationary control panel to see where the intrusion is taking place. The wearer can be immediately alerted as to the location of the potential intrusion by glancing at the bracelet 14 on his wrist. The vibrating feature of the bracelet 14 can alert the user when the user is asleep or otherwise unable to see the alarm indicators 20*a-h* light up.

The display unit 12 includes an on/off switch 16 having "ON" and "OFF" positions. Sliding the switch 16 to "ON", as shown in FIG. 4, activates the display unit 12, the alarm indicators 20*a-h* and the motion sensor units 50*a-h*. Sliding the on/off switch 16 to the "OFF" position, disables the display unit 12 and deactivates the motion sensor units 50*a-h*.

The display unit 12 includes a plurality of deactivation buttons 22*a-h* positioned adjacent to the alarm indicators 20*a-h*, as shown in FIGS. 4 and 5. Each deactivation button 22*a-h* is operatively linked to one of the alarm indicators 20*a-h*, respectively, to selectively deactivate and reactivate particular alarm indicators 20*a-h* and the respective motion sensor units 50*a-h* associated with each alarm indicator 20*a-h*.

Sliding the on/off switch 16 to "ON" activates all motion sensor units 50*a-h*. By pressing particular deactivation buttons 22*a-h*, the user can selectively deactivate particular alarm indicators 20*a-h* and the motion sensor units 50*a-h* associated therewith. For example, to deactivate motion sensor unit number one 50*a*, the user presses deactivation button 22*a*, which corresponds to the alarm indicator number 20*a* on the bracelet 14. The button 22*a* is hold until the deactivation button 22*a* flashes and beeps once. The deactivation button 22*a* will continue to flash every fifteen seconds as a reminder to the user until the display unit 12 is turned off or the motion sensor 50*a* is reactivated. The deactivation buttons 22*a-h* light up and flash when pressed to deactivate one or more of the motion sensor units 50*a-h*. To reactivate the deactivated motion sensor unit 50*a*, the deactivate button 22*a* linked to motion sensor unit 50*a* is pressed again, and the button 22*a* flashes and beeps once. Once reactivated, the reminder flash stops. The color of each deactivation button 22*a-h* matches the color of the indicator number 20*a-h*, respectively, beside it, as shown in FIGS. 4 and 5.

If one of the indicator numbers 20*a-h* flashes intermittently and there is no vibration sensation when the display unit 12 is switched to "on", this indicates that one or more features associated with the particular motion sensor unit 50*a-h* linked to the flashing indicator number 20*a-h* is not functioning properly.

The display unit 12 includes an "always on" green light 18 that comes on when the on/off switch 16 is turned on. Continuous illumination from the light 18 indicates that the bracelet 14 (but not the sensor units 50) is operating properly. If the light 18 flashes intermittently, that is an indication that a feature on the display unit 12, such as lighted indicator numbers 20*a-h*, deactivation buttons 22*a-h* and/or vibration feature, is not properly functioning.

The display unit 12 includes an emergency help button 24 on the bracelet 14, as shown in FIGS. 4 and 5. The display unit 12 is operatively linked to the emergency 911 telephone number, such that pressing the help button electronically connects to an emergency 911 services dispatcher. When one of the motion sensor units 50*a-h* detects motion and activates an alarm or any other time the user needs emergency response services, the user can press the help button 24 to be connected to the emergency 911 service to dispatch police, fire or medic responders. Because the call to emergency 911 is controlled manually by the user, false alarms are minimized.

In addition to security, the bracelet 14 can be used in emergencies such as fire and medical emergencies. For example, the bracelet 14 can be worn by persons with known medical conditions or those prone to falls, such as the elderly. In the event of a medical emergency, the user can summon assistance by pressing the Help button 24.

As shown in FIG. 4, the mobile display unit 12 can include a sliding intensity switch 29 that varies the level of vibration in the bracelet 14. As such, the user can adjust the level of desired vibration that is comfortable for the user. The bracelet 14 automatically vibrates when switch 29 is moved. The level of vibration sensation increases or decreases depending on the direction the switch is moved. For example, the level of vibration can increase when the switch 29 is moved to the right, as shown in FIG. 4, and can decrease when moved to the left.

The display unit 12 includes a test button 26 for testing the operation of features of the display unit 12 and the motion sensor units 50*a-h*. To run a test, the on/off switch 16 is turned off, and the test button 26 is pressed. The indicator numbers 20*a-h* on the bracelet 14 light up consecutively one by one. Simultaneously, the bracelet 14 vibrates, with the vibration pausing between the lighting of each indicator number 20*a-h*. Also simultaneously, the number on the corresponding motion sensor unit 50*a-h* lights and its alarm sounds. The test mode automatically shuts off when all motion sensor units 50*a-h* have been tested. The test mode allows the user to troubleshoot, and find out specifics of what feature may not be functioning properly within the motion sensor units 50*a-h* or on the display unit 12.

For example, vibration coupled with a failure of a particular display unit 12 indicator number 20*a-h* to light up indicates that the particular indicator number is broken. A lighted indicator number 20*a-h*, vibration of the bracelet 14, and no light on a motion sensor unit 50*a-h* indicates the particular motion sensor light is broken. A lighted indicator number 20*a-h*, vibration of the bracelet 14, a lighted corresponding motion sensor unit 50*a-h*, but no sound alarm emanating from the particular motion sensor unit indicates the sound alarm on the particular motion sensor unit is broken. A lighted motion sensor unit 50, coupled with no alarm emanating from the motion sensor unit 50 indicates the alarm is broken. A lighted indicator number 20*a-h* on the display unit 12 and no vibration of the bracelet 14, coupled with functioning alarm and lighted number on the corresponding motion sensor unit 50*a-h* indicates the vibration feature of the bracelet 14 is broken. Vibration of the bracelet 14, a lighted indicator number 20*a-h* on the display unit 12, coupled with no sound alarm and no light on the corresponding motion sensor unit 50*a-h* indicates that the connection between the display unit 12 and the particular motion sensor unit is broken and/or the motion sensor unit's motion detection capabilities are malfunctioning. If every feature is working on the display unit 12 and the motion sensor unit 50, but the "always on" light 18 is flashing, then the sliding intensity switch 29 may be broken. The sliding intensity switch 29 can be tested by switching the on/off switch 16 to "on", then slide intensity switch 29 to its maximum setting, then to its minimum setting. If the level of vibration sensation does not change, then the sliding intensity switch 29 is not functioning properly.

All features on the display unit 12, including buttons 22*a-h*, 24, 26, switches 16, 29 and indicators 18, 20*a-h*, are preferably "sunken", i.e., leveled with the top surface of the bracelet 14. This minimizes the risk of the user mistakenly operating any of the features of the display unit 12 while wearing the bracelet 14 during activities or sleeping, and the buttons 22*a-h*, 24, 26, switches 16, 29 and indicators 18, 20*a-h* can still be easily operated by the user's fingertips.

Figure 14:
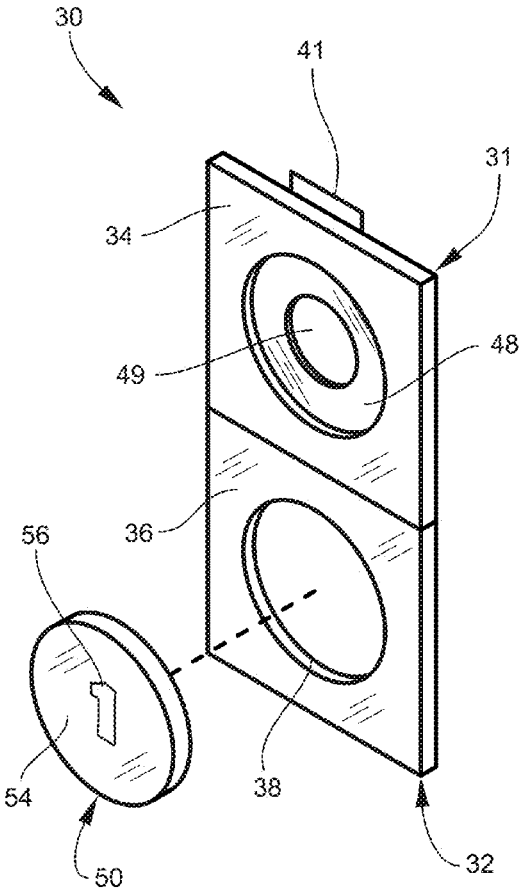
FIG. 14 is a perspective view of the bracket of FIG. 11.

The security system 10 can include attachment brackets 30, as shown in FIGS. 11-16, for facilitating attachment of the sensor units 50 to the interior of the house "H". Each bracket 30 comprises an upper section 31 pivotally connected to a lower section 32. The upper and lower sections 31, 32 can be pivotally connected by a living hinge 33, or alternatively, by other pivotal connection means such as a hinge. The upper section 31 has an inner side 34 and an outer side 35, and the lower section 32 has an inner side 36 and an outer side 37. The lower section 32 has an opening 38 formed therein that is shaped and sized to receive the motion sensor unit 50, as shown in FIG. 14.

Figures 11, 12, 13:
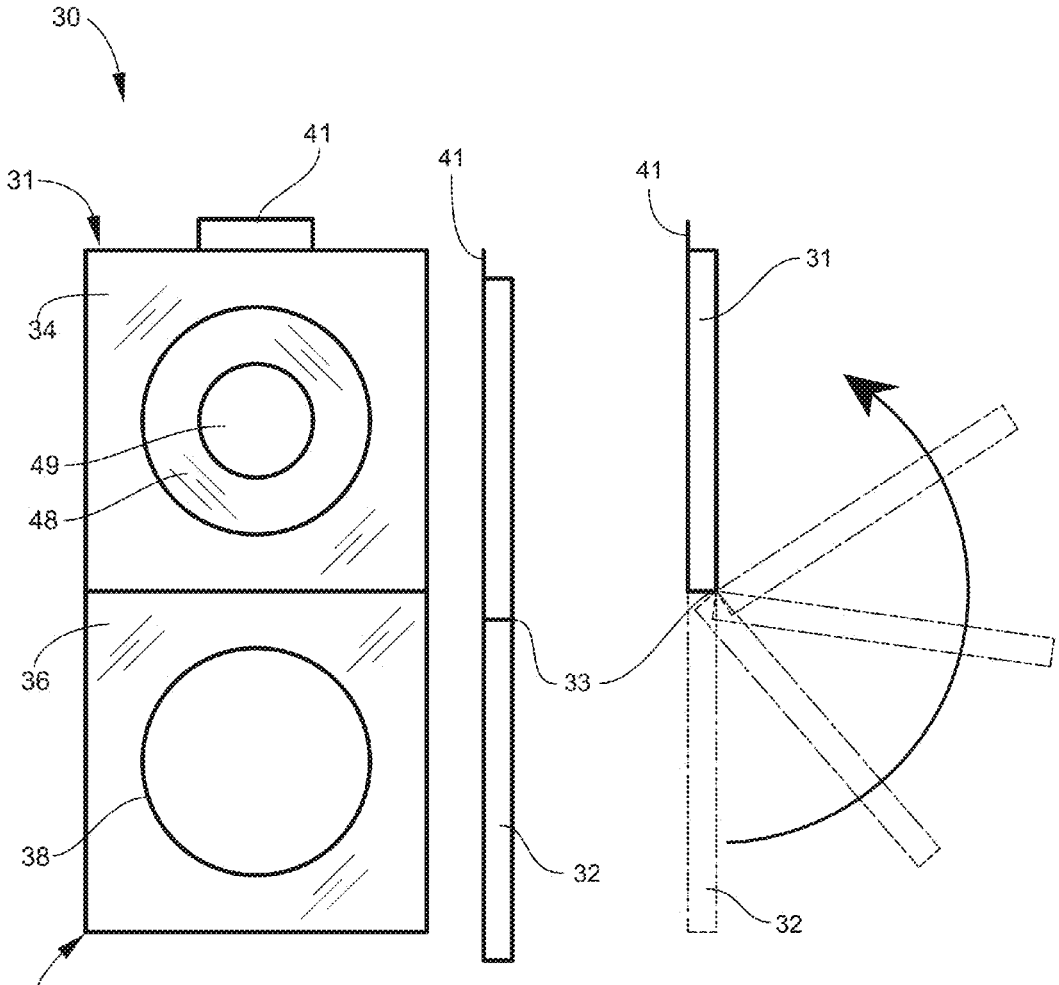
FIG. 11 is a top plan view of an attachment bracket according to a preferred embodiment of the invention.
FIG. 12 is a side view of the bracket of FIG. 11.
FIG. 13 is a schematic side view of the bracket of FIG. 11.

The upper section 31 has a countersunk opening 48 defining a sensor unit display window 49, as shown in FIGS. 11 and 14. The countersunk opening 48 has a shape and size complementary to the lower section opening 38. A bracket handle 41 is mounted on the upper edge of the upper section 31.

Figure 15:
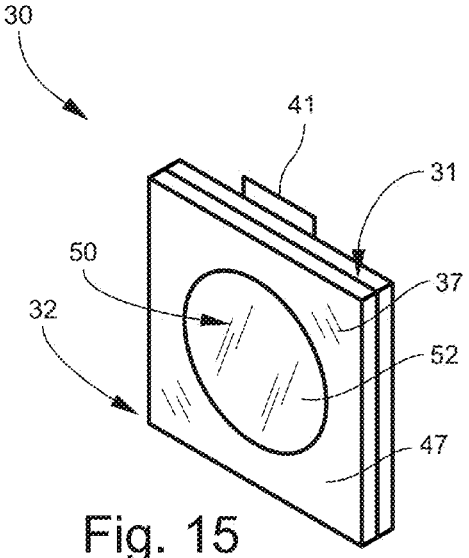
FIG. 15 is another perspective view of the bracket of FIG. 11.
Figure 16:
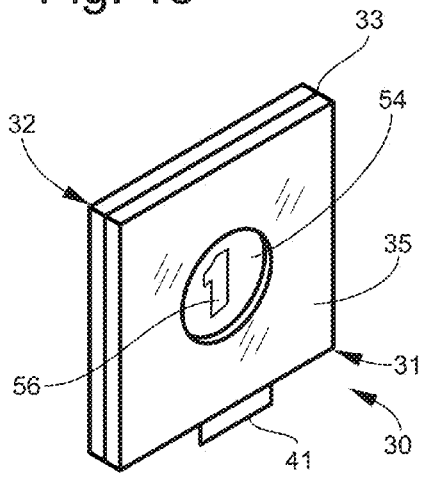
FIG. 16 is another perspective view of the bracket of FIG. 11.

The bracket 30 is moveable from an open position, shown in FIGS. 11 and 14, in which the inner side 36 of the lower section 32 is exposed and the lower section opening 38 can receive the sensor unit 50, to a closed position, shown in FIGS. 15 and 16, in which the lower section 32 covers the inner side 34 of the upper section 31 and contains the sensor unit 50 therein, by pivoting the lower section 32 upward as shown in FIG. 13. Alternatively, the upper section 31 can be pivoted downward onto the lower section 32.

The bracket 30 includes attachment means for attaching the motion sensor unit 50 to the interior of the house "H". The attachment means can be a layer of adhesive 47 on the outer side 37 of the lower section 32. The adhesive can be covered by a peelable film layer. With the sensor unit 50 contained in the bracket 30, the film layer can be peeled away exposing the adhesive 47 on the outer side 37 of the lower section. The bracket 30 can be mounted at a desired location such as the interior side of a door or window by positioning the outer side 37 of the lower section 32 against the door or window interior. As such, the motion sensor compartment 52 of the motion sensor unit 50 faces the exterior of the house "H", and the alarm compartment 54 with the identifying number 56 thereon faces the interior of the house "H."

In addition to attaching the motion sensor unit 50 to a surface area, the bracket 30 protects the motion sensor unit 50 from surface damage. The surface area on which the bracket 30 is to be mounted should be cleaned before mounting. The bracket 30 can be opened using the handle 41. The film layer is peeled off to expose the adhesive 47, and the bracket 30 is placed into position, and the outer side 37 of the lower section 31 is pressed against the desired surface for approximately fifteen seconds. The motion sensor unit 50 is inserted into the lower section opening 38, which is adhered to the interior of the house "H". The upper section 31 is closed over the lower section 32, thereby containing the motion sensor unit 50 securely within the bracket 30. As such, the number 56 on the motion sensor unit 50 can be seen by occupants of the house "H" through the sensor display unit window 49. The bracket 30 can be made of hard plastic or other suitable material, and preferably is black or white.

The security system 10 can function without any third party customer service, thereby eliminating monthly service charges. When an alarm is activated, the user decides whether to contact authorities. Alternatively, there could be a payment option, in which a payment would be required to activate the help button 24 on the display unit and/or an ongoing monthly charge to keep the help button 24 operational.

The security system 10 provides numerous advantages, such as minimizing false alarms, and alerting occupants before a break-in occurs. No wire or drilling is required. The mobile display unit 12 comprises a bracelet 14 worn on the user's body, which reduces reaction time. The use of light and vibration notification instead of voice and visual notification minimizes the chance of not being alerted due to being asleep or in the shower or bathroom. Occupants can walk around the interior of the home "H" with motion sensors 50 activated without triggering an alarm. The security bracelet 14 is adjustable and comfortable, and can be worn in bed and shower. The sensors 50 are not mounted to the house "H", thereby enabling users to switch sensor units 50 around freely from bracket 30 to bracket 30. All forms of intrusion notifications for the system 10 work together to point out the area of intrusion.

A security system and a method of using same are described above. Various changes can be made to the invention without departing from its scope. The above description of various embodiments the invention are provided for the purpose of illustration only and not limitation—the invention being defined by the claims and equivalents thereof.

What is claimed is:

1. A security system comprising:

(a) at least one motion sensor unit for attaching to a building structure, the motion sensor unit housing a sensor section comprising a motion sensor adapted for detecting motion, and a shield section adjacent to an inner surface of the sensor section, the shield section comprising shielding material having electromagnetic shielding properties, the shielding material providing a barrier to the sensor section and blocking the sensor from detecting motion proximate the inner surface of the sensor section, whereby the sensor does not detect motion occurring internally of the building structure when the sensor unit is positioned with the shield section facing the interior of the building structure; and (b) alarm means operatively connected to the at least one motion sensor unit whereby detection of motion by the sensor activates the alarm means.

2. The security system according to claim 1, wherein the alarm means comprises an alarm section positioned on the at least one motion sensor unit adapted for producing light or sound upon the motion sensor detecting motion.

3. The security system according to claim 2, wherein the shield section is positioned intermediate the sensor section and the alarm section.

4. The security system according to claim 2, wherein the alarm means further comprises an alarm display unit operatively connected to the at least one motion sensor unit, and comprising at least one alarm indicator corresponding to the at least one motion sensor unit, and wherein the at least one alarm indicator produces light, sound or vibration upon detection of motion by the at least one motion sensor.

5. The security system according to claim 4, wherein the alarm display unit comprises a bracelet adapted to be worn on a user's wrist.

6. The security system according to claim 1, wherein the alarm means comprises an alarm display unit operatively connected to the at least one motion sensor unit, the alarm display unit comprising at least one alarm indicator corresponding to the at least one motion sensor unit, and wherein the at least one alarm indicator produces light, sound or vibration upon detection of motion by the at least one motion sensor.

7. The security system according to claim 1, wherein the shielding material comprises sheet metal.

8. A security system according to claim 1, wherein the motion sensor comprises a tomographic motion detection sensor that can detect motion through obstructions other than the shield section.

9. The security system according to claim 1, further comprising a motion sensor unit bracket for housing the at least one motion sensor unit, the bracket comprising:

(a) a first section having an inner side and an outer side, and a first section opening shaped and sized to receive the at least one motion sensor unit;

(b) a second section pivotally connected to the first section, and having a countersunk opening having a shape and size complementary to the first section opening, whereby the bracket is moveable from an open position wherein the inner side of the first section is exposed and the first section opening can receive the sensor unit, to a closed position wherein the second section is pivoted to cover the inner surface of the first section whereby the sensor unit is contained within the bracket; and (c) attachment means for attaching the bracket to the building structure.

10. A security system comprising:

(a) at least one motion sensor unit for attaching to a building structure, the motion sensor unit comprising a sensor section comprising a tomographic motion sensor adapted for detecting motion through opaque material, and a shield section adjacent to an inner surface of the sensor section, the shield section comprising shielding material having electromagnetic shielding properties, the shielding material providing a barrier to the sensor section and blocking the sensor from detecting motion proximate the inner surface of the sensor section, whereby the sensor does not detect motion occurring internally of the building structure when the sensor unit is positioned with the shield section facing the interior of the building structure; and (b) alarm means operatively connected to the tomographic motion sensor whereby detection of motion by the tomographic motion sensor activates the alarm means.

11. The security system according to claim 10, wherein the alarm means comprises an alarm section positioned on the at least one motion sensor unit adapted for producing light or sound upon the motion sensor detecting motion, and further wherein the shield section is positioned intermediate the sensor section and the alarm section.

12. The security system according to claim 11, wherein the alarm means further comprises an alarm display unit operatively connected to the at least one motion sensor unit, and comprising at least one alarm indicator corresponding to the at least one motion sensor unit, and wherein the at least one alarm indicator produces light, sound or vibration upon detection of motion by the at least one motion sensor.

13. The security system according to claim 10, wherein the at least one motion sensor unit comprises a plurality of motion sensor units for positioning at desired locations of a building structure.

14. The security system according to claim 13, wherein the alarm means comprises an alarm display unit operatively connected to the plurality of motion sensor units, and comprising a plurality of alarm indicators corresponding to the plurality of motion sensor units, wherein each alarm indicator is operatively linked to a particular one of the plurality of the motion sensor units and detection of motion by the particular motion sensor unit activates said corresponding alarm indicator linked to the particular motion sensor unit.

15. The security system according to claim 14, wherein each of the plurality of motion sensor units further comprises an alarm section having a sensor alarm indicator that activates upon the motion sensor detecting motion, and the shield section is positioned intermediate the sensor section and the alarm section.

16. The security system according to claim 15, wherein each sensor alarm indicator comprises a distinguishing alphanumeric character, and further wherein the plurality of alarm indicators of the alarm display unit includes a plurality of alphanumeric characters, each of said alarm indicator alphanumeric characters corresponding to one of the alphanumeric characters of the sensor alarm indicators, further wherein each of the alarm indicator alphanumeric characters and each of the alphanumeric characters on the motion sensor units is illuminable with a distinctively colored light.

17. A security apparatus comprising a bracket for housing a motion sensor unit adapted for detecting motion, the bracket comprising:

(a) a first section having an inner side and an outer side, and a first section opening shaped and sized to receive the motion sensor unit;

(b) a second section pivotally connected to the first section, and having a countersunk opening having a shape and size complementary to the first section opening, whereby the bracket is moveable from an open position wherein the inner side of the first section is exposed and the first section opening can receive the motion sensor unit, to a closed position wherein the second section is pivoted to cover the inner surface of the first section whereby the motion sensor unit is contained within the bracket; and (c) attachment means for attaching the bracket to a building structure.

18. A security apparatus according to claim 17, further comprising the motion sensor unit and alarm means operatively connected to the motion sensor unit, whereby detection of motion by the motion sensor unit activates the alarm means.

* * * * *